US005492329A

United States Patent [19]

Kronin

[11] Patent Number: 5,492,329

[45] Date of Patent: Feb. 20, 1996

[54] GOLF PUTTER WITH ELECTRONIC LEVELING DEVICE AND MESSAGE DISPLAY

[76] Inventor: Edward J. Kronin, 310 Center St., Westbury, N.Y. 11590

[21] Appl. No.: 394,462

[22] Filed: Feb. 27, 1995

[51] Int. Cl.[6] ..... A63B 69/36

[52] U.S. Cl. ..... 273/186.3; 273/162 B; 33/366; 33/334

[58] Field of Search ..... 273/186.2, 186.3, 273/187.6, 194 R, 194 A, 162 B, 187.4, 187.5, 162 F, 193 R, 163 R; 33/366, 334

[56] References Cited

U.S. PATENT DOCUMENTS

| | | | |
|---|---|---|---|
| 2,787,470 | 4/1957 | Barrus et al. | 273/186.3 |
| 3,030,373 | 12/1962 | Mathews et al. | 273/186.3 |
| 4,930,787 | 6/1990 | Nobles | 273/162 B X |

*Primary Examiner*—George J. Marlo

[57] ABSTRACT

A putter including an electronic leveling device contains:

(a) a source of electrical energy;

(b) a display means for producing a signal composed of a plurality of light emitting diodes when the circuit is energized;

(c) a light diffusion means placed over said signal for displaying messages and the like for promotional and advertising purposes;

(d) an electric circuit means for electrically joining the display means to said source of electrical energy; and (e) a switch means in said electric circuit means and movable between a closed position where electrical energy is permitted to pass from said source of electrical energy to said display means through the aforementioned electric circuit means to electrically energize said display means producing a signal composed of a plurality of LEDs and illuminating the light diffusing means that lights a message or the like on the surface of said light diffusing means, said switch means being in said closed position when said longitudinal axis of said putter head is held at an angle that is unparallel to the horizon and an open position in which electrical energy is prevented from passing from said source of electrical energy to said display means through said electrical circuit means when said longitudinal axis of the putter head is held parallel to the horizon.

9 Claims, 2 Drawing Sheets

GOLF PUTTER WITH ELECTRONIC LEVELING DEVICE AND MESSAGE DISPLAY

BACKGROUND OF THE INVENTION

1. Field of the Invention

The present invention relates, in general to golf clubs, and more specifically to an electronic leveling device and a message display incorporated into the construction of a golf club putter for helping a golfer gauge the slope and pitch of the putting surface to enhance solid contact with the ball during the golf swing, and to display a message or messages to the golfer.

2. Information Disclosure Statement

A preliminary search in class 273, and subclasses 183D, 186A, 186C, and 186R in the Examiner's art and files disclose the following patents: Skelly U.S. Pat. No. 2,919,922; McCullough U.S. Pat. No. 2,976,046; Aitken, U.S. Pat. No 2,158,211; Evans, U.S. Pat. No. 3,270,564; Ikeda, U.S. Pat. No. 3,429,576; Brandell, U.S. Pat. No. 3,753,564; Lancelotti, U.S. Pat. No. 3,979,125; Barasch, U.S. Pat. No. 4,094,504; Thompson. U.S. Pat. No. 4,194,739; Richards, U.S. Pat. No. 4,535,986; Dollar, et. al., U.S. Pat. No. 4,789,160; and Nobles, U.S. Pat. No. 4,930,787. It is difficult, when on a putting surface, to accurately gauge the slope and pitch of the putting green by simple visual examination. It is equally difficult for the golfer to judge if the golf club head of the putter is parallel to the putting surface, and to determine the position of the golfer's hands and body in juxtaposition to the ball, just prior and during the act of striking the ball during the golf swing. Each of the above cited patents disclose a means for giving some indication of the slope and pitch of the green or providing information about and possibly improving the golf swing, and, thus, apparently relate to the present invention. One such device is disclosed in Nobles, U.S. Pat. No. 4,930,787, issued on Jun. 5, 1990, in which a signaling device is attached to the golf club putter or the like. Said signaling device together with a source of electrical energy, a signal means, switch means, display means, and electrical conductor means is used to indicate when the club is not parallel to the putting surface or when there is a rotation of the hands holding the putter on the backstroke.

While this method of installation is not entirely unsatisfactory, it suffers from some disadvantages, and, in addition, none of the aforementioned patents disclose or suggest an electrical leveling device containing a display means consisting of a plurality of Light Emitting Diodes (LEDS) that is fitted with a light diffuser and which can be used to display a lighted message or symbol visible to the golfer when said electrical leveling device is energized during the process of aligning the longitudinal axis of the putter to the putting surface. Said display means with a light diffuser can be used to display a message or symbol to the golfer can, therefore, be used for product or service promotions. One of the disadvantages of the Nobles U.S. Pat. No. 4,930,787 is getting the body of the signaling and leveling device properly installed to putter heads when the vast majority of said clubs have irregular, angled or incomplete back surfaces making attachment of the body difficult or impossible. Another problem is the lack of protection of the attached signaling device, containing electrical components, that protrudes from the rear of the putter and can be struck during use and during insertion of said club into and out of the golf bag, or the like. A third disadvantage involves the placement of the master switch means on the body of the signaling device that is attached to the club head. Therefore, the display means, consisting of an LED, would be on constantly during the entire golf swing and would be a major distraction to golfers who must focus on the ball at all times during the golf swing. None of the above listed patents suggest a golf club with an electronic leveling device in the putter head that displays a message or symbol when the system in energized during the process of aligning the club head to the horizon of the putting surface. Said electronic leveling device with its message or symbol display consists of a source of electrical energy, display means for producing a signal when electrically energized, light diffusion means, electric circuit means for electrically coupling the display means to the source of electric energy, and a single pole dual throw switch means inserted in the electrical circuit means and movable between an open position in which electrical energy is prevented from passing from the source of the electrical energy to the display means through the electric circuit means therethrough and the closed position in which the electrical energy is permitted to pass from the source of the electrical energy to the display means through the electrical circuit means to electrically energize the display means, and, thus, illuminating the diffuser means producing a lighted message, symbol, or the like, the switch means being in the closed position when the longitudinal axis of the putter head is held at an angle that is not parallel to the horizon, and the momentary push switch located on the handle of the club is in a fully depressed and engaged position.

SUMMARY OF THE INVENTION

The purpose of the present invention is to provide a putter containing an electronic leveling device in the head of the club to help improve a golfer's putting stroke or the like, by energizing a light emitting diode (LED) display when the longitudinal axis of the putter head is held at an angle that is not parallel to the horizon, and to illuminate a light diffuser positioned to produce a lighted message, symbol, or the like, which can be used in activities designed to promote goods, services, or a person, organization, or the like, and which can be a massed-produced marketable product.

The invention Is both an improvement on the Nobles U.S. Pat. No. 4,930,787 and it contains features unique to its own design and utilization. It is an improvement on the Nobles U.S. Pat. No. 4,930,787 in that the electronic leveling device is built into the club head of the putter and is, thereby, protected by a surrounding enclosure, is properly positioned and firmly attached to interior base of the putter head eliminating the difficult or impossible task of attaching a separate signaling device to assymetically shaped putters, its display means is composed of a plurality of LEDs easily seem in the brightest day light conditions that are located along the top longitudinal axis of the putter head, and it contains a momentary push switch located on the handle of the putter enabling the golfer to easily prevent the display from being energized during the golf stroke or the like. The present invention also features a unique light diffusing means that is located above the LED display means to illuminate a message or symbol that can be used to promote or advertise an idea, goods, services, a person, organization or the like.

It is one object of the present invention to provide a novel electronic level indicating putter that has the electronic leveling components and display built into the the club head where they are protected by surrounding material eliminating the need to set or attach other parts to the club.

Another object of the present invention is to provide a device to help improve a golfer's putting stroke by indicating when the longitudinal axis of the club head is not parallel to the horizon.

Another object of the present invention is to provide a plurality of LEDs in the display means along the top plane of the putter club head that are visible in bright daylight and that are adjacent to the point where the club strikes the ball.

Another object of the present invention is to provide a light diffuser that is positioned above the LED display means to illuminate a message or symbol that can be used to promote or advertise an idea, goods, services, a person, organization, or the like.

Still another object of the present invention is to install the source of energy for the electronic leveling device in the hollow handle of the shaft, and to place on the handle of the club a momentary push switch connected to the circuit means that can be used to preventing the energizing of the display means during the putting stroke.

Other objects, advantages and novel features of the invention will become apparent from the following detailed description of the invention when considered in conjunction with the accompanying drawings wherein like reference numbers identify the parts throughout.

DESCRIPTION OF THE PREFERRED EMBODIMENT

Figures 1, 2, 3:
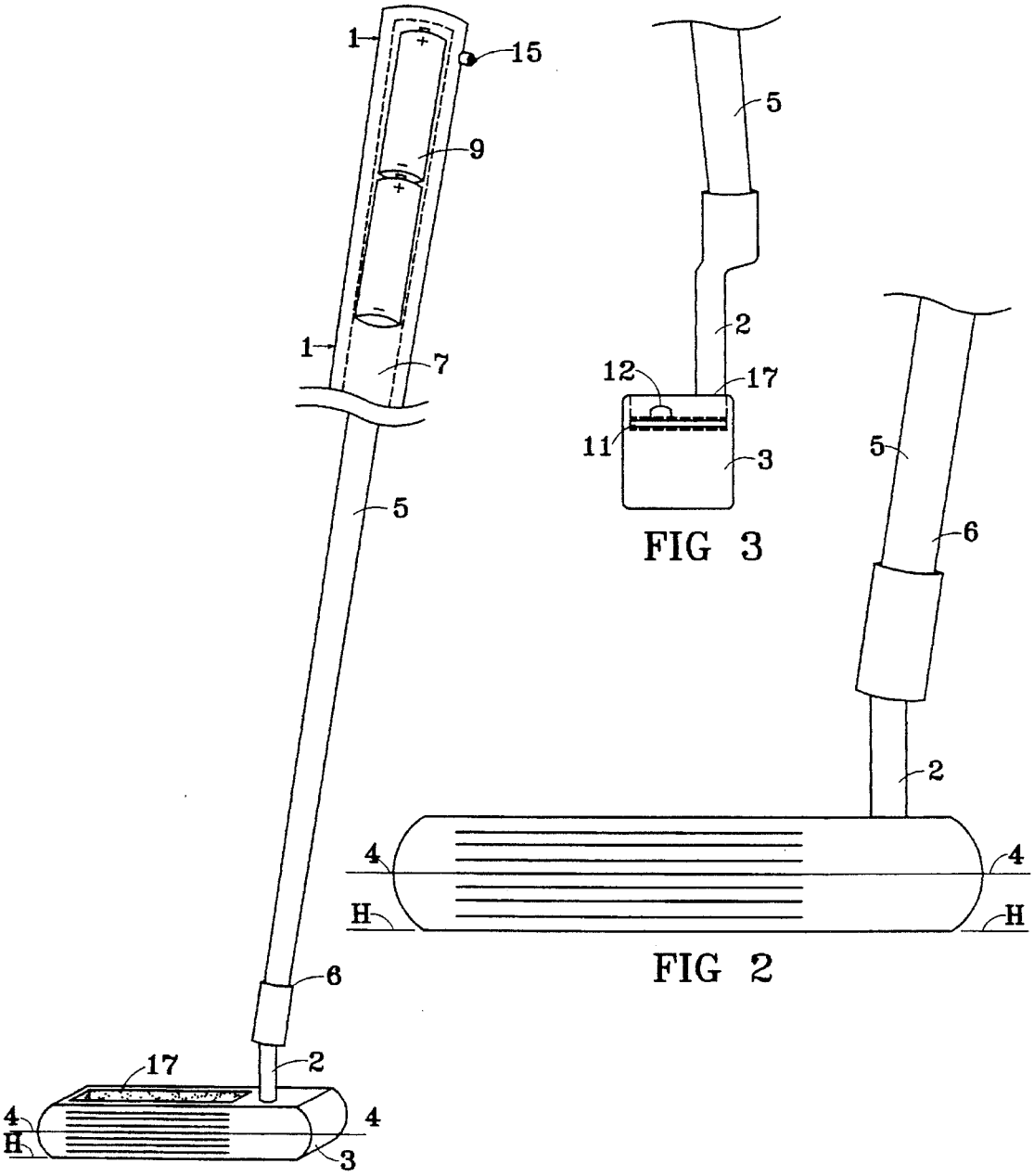
FIG. 1 is a side view of the putter according to the invention with an exploded view taken at line 1—1.
FIG. 2 is a front view of the putter.
FIG. 3 is a side view of the putter at the end opposite the shaft.

The preferred embodiment of the electronic leveling device 8 and message display is to be contained in the club head of a typical golf putter 2 of any well-known construction. Therefore, the golf putter 2 includes a putter head 3 having a longitudinal axis 4 and includes an elongated shaft 5 . The shaft 5 has a first end 6 attached to the putter head 3 and a second end 7 distant from the putter head 3 for being held by a golfer.

The electronic leveling device 8 includes a source 9 of electrical energy. The source 9 of electrical energy preferably consists of two typical batteries that are size AA such as, for example Rayovac Alkaline Maximum dry cells each having a 1.5 voltage rating, that are arranged in series to produce a 3.0 voltage rating. The two size AA batteries are contained in the hollow center of the elongated shaft 5 in the second end distant from the putter head and are accessible through the grip 10 material at the point furthest from the putter head 3.

The electronic leveling device 8 includes a display means 11 for producing a signal when electrically energized. The display means 11 preferrably includes a plurality of light emitting diodes (LEDs) 12 for producing a visible signal when electrically energized. The LEDs 12 preferrably consist of a green LEDs (for example, the ones marketed by Tandy Corporation of Fort Worth, Tex. through its Radio Shack division each having a forward voltage of 2.0 volts and a forward current of 20 mA. The display means 11 consisting of a plurality of LEDs produces a light signal when energized by two size AA batteries arranged in series and that no resistance is needed between the batteries and these particular LEDs.

Figures 4, 5, 6:
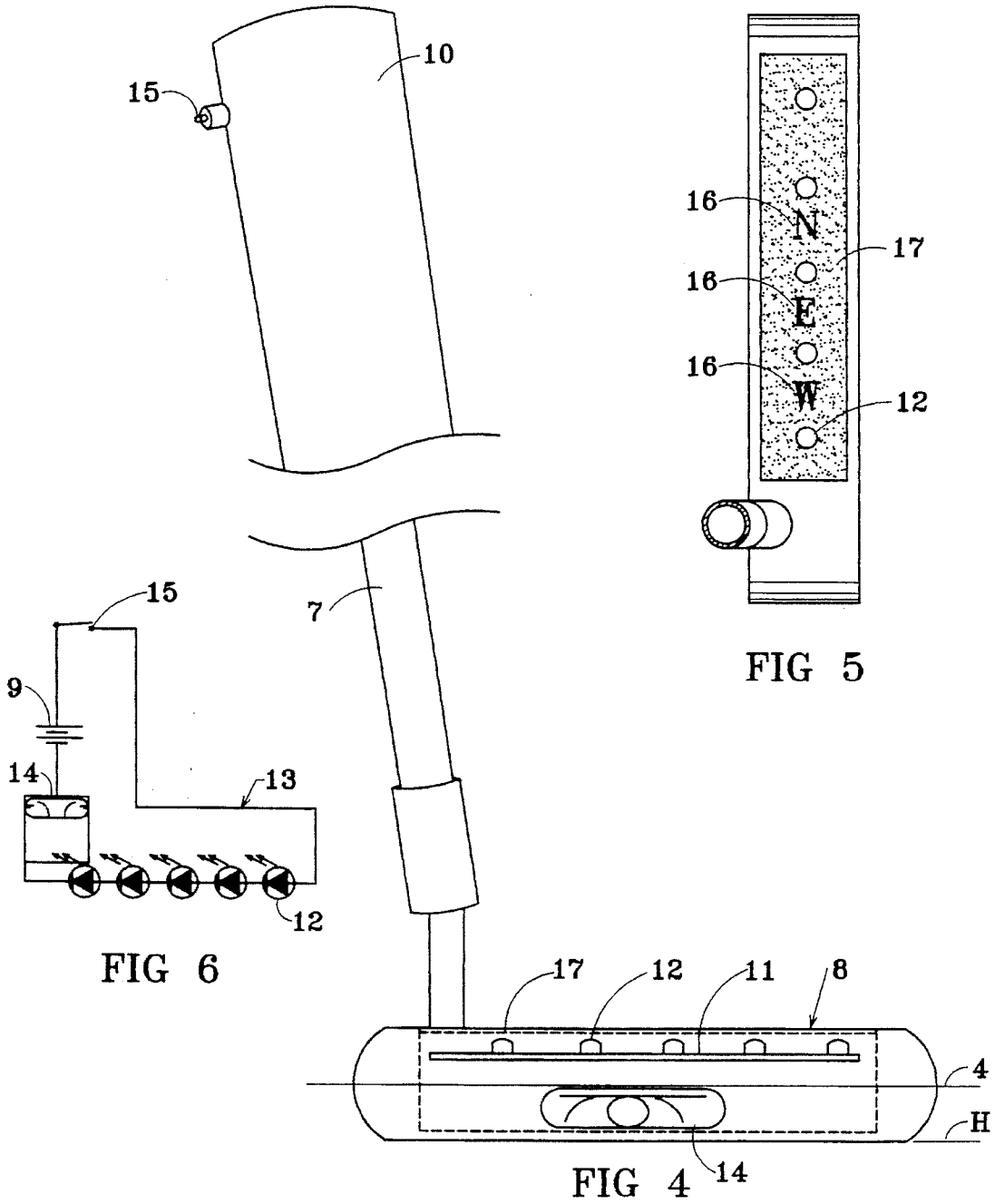
FIG. 4 is a back view of the club head as taken with portions thereof omitted for clarity.
FIG. 5 is a top view of the club head of the present invention.
FIG. 6 is an electrical schematic of the electrical components of the display and leveling devices of the present invention.

The electronic leveling device 8 includes electrical circuit means 13 for electrically coupling the display means 11 to the source 9 of electrical energy. The electrical circuit means 13 is illustrated schematically in FIG. 6 as consisting of a variety of conductive materials electrically joining the various electrical components of the signaling means 11 together, although other methods could also be used by those experienced and skilled in the art.

The electronic leveling device 8 includes a switch means 14 that is inserted in the electrical circuit means 13 for controlling the flow of electrical energy through the electric circuit means 13 from the source 9 of electrical energy to the display means 11. The main switch 15 ideally consists of a single pole, single throw momentary push button switch that is manually operated by the user to energize or de-energize the electrical circuit and preferrably is located at the second end 7 of the shaft at the end of the grip 10 providing easy accessibility for the golfer. The switch means 14 preferrably consists of a single pole dual throw switch inserted in the electric circuit means 13 between the source 9 of electrical energy and the display means 11 and movable between the closed position in which electrical energy is able to pass from the source 9 of electrical energy to the display means 11 then through to electrically energize the display means 11 illuminating the plurality of LEDs 12 and illuminating the diffuser means 17 thereby lighting the message 16 or symbol there contained and an open position in which electrical energy is prevented from passing from the source 9 of electrical energy to the signal means 11 therethrough. The switch means 14 consists of a typical mercury bulb switch having a single pole dual throw configuration fixedly mounted relative to the longitudinal axis 4 of the club head 3 so that it will be in the closed position when the longitudinal axis 4 of the club head is angle upward or downward relative to the horizon thereby energizing the electrical circuit, and the switch means 11 will be in an open position when the longitudinal axis 4 of the club head 3 is parallel to the horizon preventing the passage of energy from the source 9 of electrical energy through the electric circuit means 13 therethrough to the display means 11 and not lighting the LEDs 12 in the display means 11 nor illuminating the message 16 or the like projected from the diffuser means 17. It is noted that the terms upward or downward relative to the horizon are relative terms meant to indicate a position where the longitudinal axis of the club head is not parallel to the horizon.

The operation and use of the electronic leveling device 8 is uncomplicated. Once the golfer depresses the main switch 15 it will produce a signal by illuminating the plurality of LEDs 12 in the display means 11 lighting the diffuser means 17 projecting the message 16 or the like thereon anytime the longitudinal axis of the club head 3 of the putter is not parallel to the horizon. If the club head 3 is parallel to the horizon the switch means will be in the open position and the electrical circuit will not be energized and no signal and message 16 or the like is produced. It is generally acknowledged by golfing experts that the club head 3 should be parallel to the putting surface or horizon when aligning the ball with the hole. By Keeping the club head 3 parallel to the horizon or putting surface the golfer is able to determine the optimum juxtaposition of the body relative to the club. Since it is generally acknowledged by golfing experts that the golf club head 3 should remain close to the putting surface both on the backstroke and the forward swing through the ball it is crucial the golfer begins the stroke with the club head parallel to the horizon. It is virtually impossible for a golfer addressing the ball, where the head of the golfer is above the ball, to accurately determine if the club head 3 is parallel to the horizon without the use of a leveling device. Furthermore, golfing experts note that the golfer must concentrate on striking the ball once the golf stroke has begun. The electronic leveling device 8 will signal the golfer when the longitudinal axis of the club head is parallel to the horizon, allowing the golfer to adjust the stance, release the main switch 15 preventing the energizing of the electrical system prior to beginning the golf stroke, thus, enabling the golfer to concentrate of striking the ball without distraction.

The placement of all electronic components of the electronic leveling device 8 in the putter head 3, except for the source 9 of electrical power and some segments of the electric circuit means 13 helps to protect these components from being struck inadvertently and damaged and maintains the traditional appearance to the shape of the club. The utilization of the putter's display means 11 and the light diffuser means 18 makes its feasible to project messages 16 or the like and, therefore, makes the present invention useful as a promotional or advertising device.

Obviously, many modifications and variances of the present invention are possible in light of the above teachings. It is therefore to be understood that the full scope of the invention is not limited to the details disclosed herein and may be practiced otherwise than as specifically described.

What is claimed is:

1. An electronic level-indicating putter comprising; a shaft, a putter head having a longitudinal axis at one end of said shaft; the other end of said shaft remote from said putter head for being gripped by a golfer; contained in said putter is an electronic leveling device comprising:

(a) a source of electrical energy;

(b) a display means for producing a signal composed of a plurality of light emitting diodes (LEDs) when the circuit is energized;

(c) a light diffusion means placed over said signal for displaying messages and the like for promotional and advertising purposes;

(d) an electric circuit means for electrically joining the display means to said source of electrical energy; and (e) a switch means in said electric circuit means and movable between a closed position where electrical energy is permitted to pass from said source of electrical energy to said display means through the aforementioned electric circuit means to electrically energize said display means producing a signal composed of a plurality of LEDs and illuminating the light diffusing means that lights a message or the like on the surface of said light diffusing means, said switch means being in said closed position when said longitudinal axis of said putter head is held at an angle that is unparallel to the horizon and an open position in which electrical energy is prevented from passing from said source of electrical energy to said display means through said electrical circuit means when said longitudinal axis of said putter head is held parallel to the horizon.

2. The combination of claim 1 in which said switch means is comprised of a single pole dual throw mercury bubble switch afixed to the longitudinal axis of the club head and located inside the putter head with said switch means inserted in said electrical circuit means and movable between a closed position in which electrical current is permitted to pass from said source of electrical energy to said display means and to electrically energize said display means, illuminating the light diffuser means that lights a message or the like, said switch being in a closed position when the longitudinal axis of said putter head is not parallel to the horizon, and in an open position in which electrical energy is prevented from passing from said source of energy to said display means and beyond when said longitudinal axis of said putter head is held parallel to the horizon.

3. The combination of claim 2 in which said electronic leveling device includes a main switch located on the end of the putter shaft remote from the club head for being gripped by the golfer said main switch for producing a visible signal when electrically energized.

4. The combination of claim 3 in which said main switch is in said electrical circuit means and movable between a closed position in which electrical energy is permitted to pass from the source of electrical energy to the display means with its LED display and its light diffuser means that is used to illuminate a message or the like for promotional or advertising purposes and an open position in which electrical energy is prevented from passing from the electrical energy source therethrough.

5. The combination of claim 4 in which said display means is a plurality of light emitting diodes (LEDs) arranged along the top longitudinal axis of the putter club head said plurality of light emitting diodes illuminating a light diffuser means and lighting and projecting a message or the like visible to the golfer.

6. The combination of claim 5 in which the light diffusing means is a body that is afixed over the display means with its plurality of LEDs utilizing the light from said LEDs to illuminate opague light filters contained in the light diffusion means and said opague light filters having openings or transparent inserts arranged to allow the shape of letters creating messages, symbols or the like that can be lighted and projected to promote or advertise a concept, product, person, organization, entity or the like.

7. The combination of claim 6 in which said opague light filters means a paper, plastic, fabric, and interactive materials that react with a variety of wavelengths including those in the infrared and ultraviolet spectrums to produce visible light that can be used to create messages, symbols, or the like to promote or advertise a concept, person, group or the like.

8. The electronic leveling putter and message maker according to claim 1 has the electronic leveling device, display means, light diffusing means, the switch means composed of a single pole dual throw mercury bulb switch, and segments of the electric circuit means in the club head and a source of power means and parts of the electric circuit means in the shaft of the club furthest from the club head.

9. The combination of claim 8 in which the source of power consists of two size AA batteries or the like in the shaft of the club at the end furthest from the club head.

* * * * *